US005683174A

United States Patent [19]

Lena, Jr.

[11] Patent Number: 5,683,174

[45] Date of Patent: Nov. 4, 1997

[54] LIQUID CELL ARTICULATED ARTISTIC DISPLAY

[76] Inventor: Frank David Lena, Jr., 11700 Iowa Ave. Suite 203, Los Angeles, Calif. 90025

[21] Appl. No.: 451,669

[22] Filed: May 26, 1995

[51] Int. Cl.[6] ..... F21V 9/12

[52] U.S. Cl. ..... 362/318; 362/101; 40/406

[58] Field of Search ..... 362/96, 101, 284, 362/318, 806; 40/406, 409, 437; 446/219, 267, 485

[56] References Cited

U.S. PATENT DOCUMENTS

| | | | |
|---|---|---|---|
| 2,953,676 | 9/1960 | Glasser et al. | 362/318 |
| 3,245,310 | 4/1966 | Aldcroftt | 362/318 |
| 3,613,264 | 10/1971 | Vitka et al. | 40/406 |

*Primary Examiner*—Y. My Quach

*Attorney, Agent, or Firm*—Gene Scott-Patent Law & Venture Group

[57] ABSTRACT

A liquid cell articulated artistic display system designed for introducing the natural phenomena of light refraction into manmade environments in a controlled manner, the display system including a light transmissive container partially filled with two or more immiscible liquids having a difference in specific gravity between 0.1 and 0.02. The container is slowly oscillated so that each of the liquids create a continuous series of distinctive wave sets mutually interacting with one another to create a clearly delineated wave phenomenon. A light beam is directed through the oscillating container and is refracted by the opposing wave sets causing the interactive wave phenomenon, thereby projecting a captivating, constantly changing wave pattern onto a visible surface.

4 Claims, 2 Drawing Sheets

LIQUID CELL ARTICULATED ARTISTIC DISPLAY

BACKGROUND OF THE INVENTION

1. Field of the Invention

This invention relates generally to moving art displays and more particularly to a multi-phase, liquid cell system for projecting a distinctive moving wave pattern of refracted light onto a surface as an artistic display.

2. Description of Related Art

Invention and use of liquid display devices are known to the public, as they are frequently employed for lighting or aesthetic purposes.

For example, Choate U.S. Pat. No. 4,742,439 discloses a desktop kinetic display device with a housing unit, an electric lamp, an electric motor and a circular, light transmissive polarized cell. The housing includes a light transmissive plate over which the polarized cell is removably mounted. The transmissive plate serves to direct diffused light from the lamp onto one side of the cell. The cell itself has a chamber filled with liquid and a plurality of small birefringent elements that float randomly in the liquid. The motor's drive shaft rotates the polarized cell, and as it rotates the birefringent elements disperse light from the lamp into a variety of constantly changing colors and hues that are visible from the side of the cell remote from the diffuser.

Gugeler U.S. Pat. No. 3,964,194 discloses a liquid display device with changeable colors. This device creates a constantly changing, completely random multi-colored effect by the action of air bubbles traveling upwardly through a fluid. The device has an illumination source around which parallel light transmissive walls are structured. The spaces between the walls form narrow working chamber gaps which contain fluid. Bubbling air is supplied from a manifold at the lower ends of the fluid containing gaps and vents from the upper ends of the gaps while the illumination source transmits light through the walls and the fluid. A reflective surface over the outer face of the device provides an opaque appearance when the device is turned off.

George, Jr. U.S. Pat. No. 4,271,458 discloses a decorative light tubing which has unbiased miniature lamps connected in series by soldering or welding the ends of flexible wire leads together to form parallel strings between a pair of elongated parallel wire conductors. The light tube is filled with mineral oil or other clear, viscous dielectric fluid to protect the lamps and wiring against the adverse effects of vibration, shock and moisture while also enhancing the visual effect.

As disclosed, these prior art liquid display devices are designed so that it is the look of the liquid display itself, and not the resulting refracted light pattern, that is of interest. In fact, these prior art devices are generally constructed with the liquid cell too close to the light source for any substantial projection of refracted light to occur. However, while the flow of illuminated, colored liquid can be aesthetically pleasing, the refraction and projection of light as it moves through water also has aesthetic qualities of its own.

Orak U.S. Pat. No. 5,165,781 discloses a flashlight designed to project light through a variety of different colored fluids. This is accomplished by positioning an exterior transparent cup around the light source, and a middle transparent cup between the light source and the exterior cup. The two transparent cups define an outer chamber to receive colored fluid. An interior transparent cup is positioned between the light source and the middle transparent cup, creating an inner chamber for receiving another colored fluid. When the light is emitted from the light source, it passes through the colored fluids and colored light is emitted from the exterior transparent cup. However, although this invention projects light through a liquid, as disclosed, the object of this configuration is not to create a unique light pattern but rather to simply project a variety of different colored light from the flashlight.

Zimmermann, German patent 2,801,354 discloses a liquid light organ designed to create refracted light that enhances the rhythm of music at a disco or at home so as to add pleasure to the dance and music. The exterior housing of the device is a hollow-bodied cylinder through which no light can escape, except through a rectangular hole removed from the top of the cylinder. Along the perimeter of the inside of the cylinder is a coil that is fed an electric current modulated by a musical source, such as a radio or record player. The magnitude of the current is controlled to create a desired effect. The base and top lid are made of plastic or glass and the interior cylinder is filled with water or alcohol which can be dyed different colors. Underneath the clear base is a bright light that passes through the liquid to its moving surface which refracts the light. The resulting light patterns change as the liquid's movement responds to the rhythm and volume of the music.

This patent attempts to create an aesthetic refracted light display by projecting light through a liquid. However, in order to create the desired, continuously pulsing light display, the device must be electrically connected to a musical source and a current must constantly pulse through the liquid cell. This significantly limits the device, as it can only effectively be used in conjunction with an acoustic source. In addition, the device has a rather large construction, making it bulky and impractical for many applications.

Thus there is a need for an improved liquid display that continually projects aesthetic visual patterns while overcoming all of the limitations of the prior art devices. The present invention provides these, and other related advantages as described in the following summary.

SUMMARY OF THE INVENTION

The present invention is a liquid cell system that introduces the natural phenomenon of light refraction onto surfaces. In essence, the present inventive system consists of slowly oscillating a container that is partially filled with two or more liquids so that each of the liquids create a continuous series of waves through which a light is directed, thereby projecting a captivating, clearly delineated visual pattern onto a surface. Thus it is an object of the invention to capture the beauty of light refraction and introduce it into a variety of different settings to create a calm, soothing effect in a given environment. The liquid cell system is ideal for interior design purposes, as the liquid cell system can be used to project the wave pattern onto ceilings, floors or walls in homes, malls, offices or lobbies. The present invention can also be used for landscaping and architectural purposes in public plazas, walkways, fountains and the like.

Refraction of light occurs when a light wave passes through an interface between two light transmissive substances of different refractive indices. The refraction occurs because the light travels at different velocities through substances of different densities. Thus, to create a refracting condition, two or more immiscible liquids of slightly different densities (or specific gravities) are sealed within the container so that one liquid floats on top of the other, thus creating a refracting interface. As light passes through the interface, it is refracted. Thus, it is a key inventive feature of the instant invention to use at least two liquids with specific gravities that are preferably within 0.01 and 0.1 of each other, a factor which is critical to obtaining the most aesthetically pleasing pattern of refracted light.

Once the immiscible liquids of different densities are confined in the container, the container is gently pivoted so as to create a distinct wave set in each of the liquids. These independent wave sets mutually interact with one another so as to establish a clearly delineated wave phenomenon. Properly controlling the inclination and the speed at which the container is pivoted is essential to achieving optimum results of the liquid cell system, for if the container is pivoted too fast or is at too great of an incline, the liquid will tend to race into opposite ends of the container too quickly. The time duration of the projected wave patterns is compressed, resulting in an abrupt, random and chaotic light display rather than an evenly rhythmic and soothing pattern across the projected surface at all times. Thus, it is an object of the invention to limit the container's range of motion and also to provide a means by which to control the pivoting speed, so that the user may select the desired characteristics of the refracted wave pattern.

Preventing air from escaping or entering the container is a critical factor in achieving the desired wave effects, as it eliminates the problem of condensation when used in closed quarters, which would mist the cell's surface and consequently ruin the effect. Water condensation on other elements of the system could create other problems and hazards as well. It is also desirable to prevent evaporation of the liquid, so as to eliminate the need to refill the liquid in the container. Thus it is an object of the invention to seal the desired liquids within the air-tight confines of the container, so as to create an environment in which the liquid does not condense or evaporate. This is a significant advantage of the present invention, as it saves a user the time and expense of frequently cleaning the interior surfaces of the cell and replacing the liquid. If desired, the container may include holes by which to replace the liquid. However, in this embodiment, the plug used to seal the holes must provide an air-tight fit.

The container is preferably constructed out of a transparent material, such as acrylic, which can be chemically bonded to itself. Thus it is an object of the invention to provide a solid, sealed container that is light in weight, visually beautiful and inexpensive to manufacture.

To project the continuously changing wave phenomenon onto the desired surface, one or more lamps are affixed either above or below the cell. Simply by changing the intensity or color of the light, the entire effect can be easily altered to create a desired ambiance. Thus, it is an object of the invention to include a dimmer by which to monitor the intensity of the lamps as well as filters or gels which can be changed and combined easily in order to alter the color of the projected wave pattern. Alternately, the liquids can be colored to create a desired effect. Still further, the distance between the lamp and the container, the distance between the container and the surface on which the wave patterns are projected, or the speed at which the container is oscillated, can all be adjusted so as to enhance, soften or otherwise alter the projected effect. Thus, it is an object of the invention to provide numerous ways by which to alter the projected effect to suit individual tastes.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
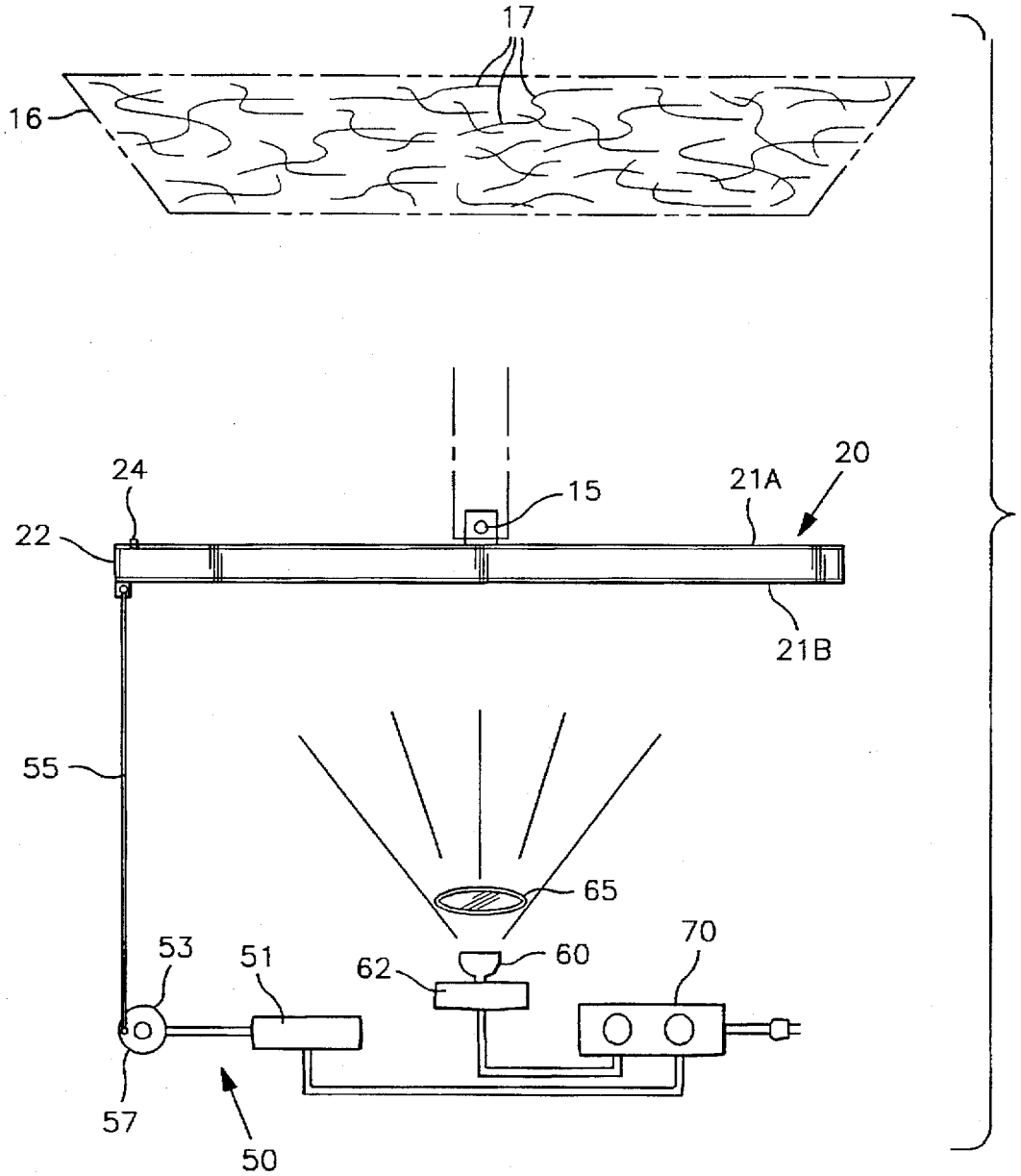
FIG. 1 is a perspective view of the preferred embodiment of the present invention.
Figure 2:
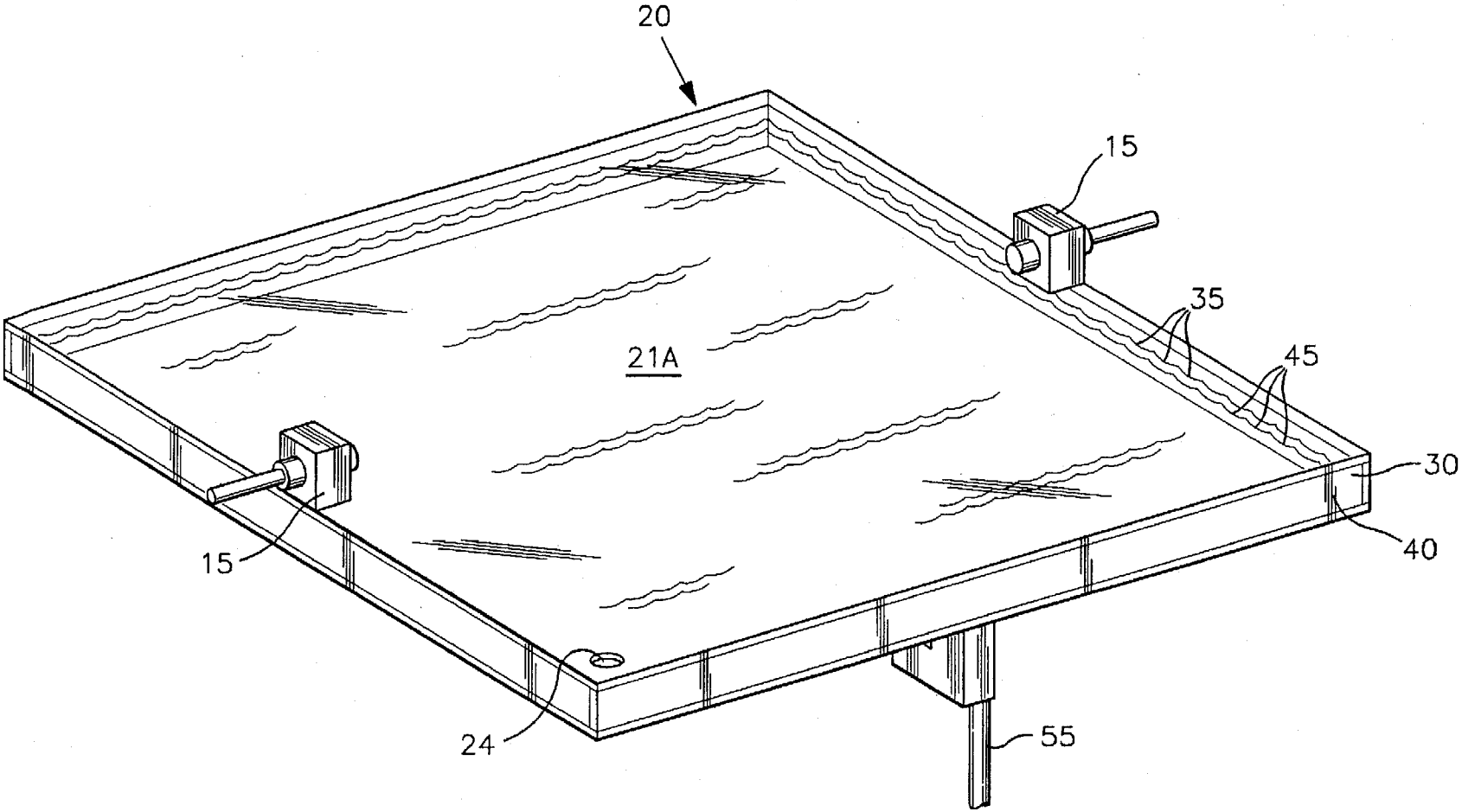
FIG. 2 is a front elevational view thereof.

FIGS. 1 and 2 show the preferred mode of the present inventive liquid cell system that is designed to generate two or more simultaneous, opposing wave patterns, so as to introduce the natural phenomena of light refraction into manmade environments in a controlled manner.

The liquid cell system preferably consists of a container 20 that is partially filled with liquids 30 and 40 and pivotally mounted on an external support 15, a motion generating means 50 imparting motion to the container 20 so as to create continuous series of wave sets 35 and 45 in the liquids 30 and 40, a light directing means 60 for directing a light beam through the container 20 so as to project a constantly changing, clearly delineated wave pattern 17 onto at least one displaced surface 16 that is visible to an observer.

The container 20 can take on any number of shapes and sizes, but it is preferably formed in a flat, shallow box-like configuration, as best shown in FIG. 1. The container has a top panel 21 A and a bottom panel 21B, both of which are made of a light-transmissive material. Preferably, the entire container 20 is fabricated from a plurality of panels of light transmissive material, such as glass, acrylic or polycarbonate. However, in an alternate embodiment, the side panels interconnecting the upfacing and downfacing panels are fabricated from an opaque material so as to produce reflected light, rainbow effects. The panels are welded together in such a way as to form an air-tight, sealed container 20 for containing liquids 30 and 40. There are numerous ways in which the liquids 30 and 40 can be put into the sealed container 20. In the preferred embodiment, liquids 30 and 40 are added to the container 20 through a fill-hole 24 located in the top panel 21A, as illustrated in FIG. 1. In this embodiment, the bottom panel 21B of the container 20 may also include a hole (not shown) by which to drain the liquids 30 and 40, thus allowing the liquids 30 and 40 to be changed as desired.

The container 20 is partially filled with at least two immiscible light-transmissive liquids 30 and 40 that are preferably void of air bubbles. It is a key inventive feature of the present inventive liquid cell system that the two liquids 30 and 40 have different specific gravities so that one liquid 30 floats on top of the other liquid 40. The difference in the specific gravities of the two liquids 30 and 40 is preferably between approximately 0.01 and 0.1. While this specification is approximate, it has proven to be ideal for creating individual wave sets 35 and 45 which mutually interact and produce a clearly delineated wave phenomenon when the container 20 is put in motion. A variety of liquid combinations with a difference in specific gravity greater than 0.1 have been tested, but the present preferred difference has proven to be superior for producing a clearly delineated wave phenomenon with superior light refracting qualities. When the container 20 is filled with more than two liquids, the specific gravity of each additional liquid is also preferably within 0.01–0.1 of at least one of the other liquids.

There are numerous different liquid combinations that have a difference in specific gravity that falls within this prescribed range. One preferred liquid combination includes a water layer 30 and an oil layer 40. The water layer 30 must be free of bacteria, minerals and other elements that could eventually cloud the liquid or the inside of the top container panel 21A. It has been found that ethanol mixed with distilled water achieves the desired balance for the water layer 30. However, the mixture must not exceed 25% ethanol or it will attack acrylic or other such substances. Preferably then, the mixture is between 10–25% ethanol, the remainder being distilled water. In this embodiment, the solubility of the oil layer 40 in the water layer 30 must be very low in order to reduce any emulsification effect. The oil layer 40 must not attack acrylic or other such materials of which the container 20 may be constructed, and, for safety reasons, it is preferably low in toxicity and has a high flash point. A mixture of 25% to 35% of 1,1,1-Trichloroethane and 65% to 75% Isoparaffinic Petroleum Solvent has been found to provide these qualities. Most importantly, however, in the above described embodiment the specific gravity of the water layer 30 is 0.96, while the specific gravity of the oil layer 40 is 0.94, thus providing the optimum specific gravity difference of 0.02, which has proven to produce the most aesthetically pleasing effect.

The motion generating means 50 imparts an oscillating pivotal motion to the container 20. The motion generating means 50 preferably comprises a motor 57 that tums a cam 53 and a pivot arm 55 to pivot the container 20. As illustrated in FIG. 1, the pivot arm 55 is secured to one of the ends 22 of the bottom panel 21B of the container 20. Preferably, the motor 57 pivots the cam 53 and pivot arm 55, and thus the container 20, in a range of motion preferably between approximately −6.5° and +6.5° inclination from level at a preferable speed of approximately 2.5 to 6 rpm. However, the exact range of motion desirable by the motion generating means 50 depends on the size and dimensions of the container, the viscosity of the fluids and the constraints of the particular environment in which the liquid display system is installed. Preferably, the system also includes a means 51 by which to control the speed at which the motion generating means 50 pivots the container 20.

The light directing means 60 preferably comprises a lamp assembly having a reflector. The lamp is preferably of the incandescent, halogen or xenon type. As illustrated in FIG. 1, the light means 60 is preferably centered beneath the bottom panel 21B of the container 20, so that light is projected through the wave phenomenon created by the wave sets 35 and 45 in the oscillating container 20 and toward the displaced surface 16. A means 62 for controlling the intensity of the output of the lamp 60 is preferably provided so as to enable a user to soften or enhance the refracted light pattern on the displaced surface 16. Depending on the environment in which the system is installed, sunlight may be utilized in place of an artificial light source. A colored, light-transmissive element 65 may additionally be placed between the light directing means 60 and the container 20 so as to impart color to the light beam. The element 65 may consist of a colored filter, gel or other such means. Alternately, one or both of the liquids 30 and 40 may be naturally or artificially colored.

The liquid cell system also includes a power source 70 by which to power both the motion generating means 50 and the light projecting means 60. The power source 70 may draw energy from either an AC or DC source. The system also includes at least one power switch (not shown) by which to turn the system on and off. Preferably, individual power switches are provided for actuating the motion generating means 50 and the light projecting means 60 separately.

Thus, the method of using a liquid cell system to form opposing wave sets 35 and 45 which create a clearly delineated wave phenomenon through which light is refracted and projected onto a displaced surface 16 comprises the following steps:

The container 20 is partially filled with at least two immiscible light-transmissive liquids 30 and 40 of different specific gravities and then sealed. The container 20 is pivotally mounted on an external support 15 between the light directing means 60 and the displaced surface 16 on which the wave pattern is to be projected. The closer the light directing means 60 is to the container 20, the closer the displaced surface 16 must be to the container 20 to realize the desired distinct wave patterns 17. The refracted wave patterns 17 become softer and more abstract the further the displaced surface 16 is from the container 20. The system's power is activated so that the motion generating means 50 moves the container 20 in an oscillating pivotal motion. The motion of the container 20 causes each liquid 30 and 40 to generate individual wave sets 35 and 45 converting the energy imparted to the container to liquid displacing motions. The exact size and shape of the wave sets 35 and 45 depends largely on the properties of each of the liquids, 30 and 40. The container's pivotal motion is limited to a range and speed in which the wave sets 35 and 45 remain distinct and yet mutually interact with one another to produce a clearly delineated wave phenomenon. The speed at which the motion generating means 50 oscillates the container 20 is quickly and easily manually adjusted with the speed controlling means 51.

It is essential that the container 20 is not oscillated too fast, or with too great of an incline, or else the liquids 30 and 40 within the container 20 will too aggressively interact with the container walls, producing a refracted wave pattern 17 that is not evenly distributed across the entire surface 16. In addition, when the liquids 30 and 40 move rapidly back and forth between the ends 22 of the container, the resulting projected wave pattern 17 is abrupt, random and chaotic instead of a constant, soothing pattern projected across the entire surface at all times.

The light projecting means 60 projects light through the container 20. The light is refracted by opposing wave sets 35 and 45 causing the interactive wave phenomenon, that is projected onto the visible surface 16.

Preferably, the system includes separate power switches by which to activate the motion generating means 50 and the light projecting means 60. Thus, if the system is located outdoors and the conditions are favorable, sunlight can be utilized in place of artificial light, thereby requiring that only the motion generating means 50 be activated to achieve the desired effect. Likewise, the dual power switches enable the light projecting means 60 to illuminate the container 20 without necessitating that it be set in motion.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A liquid cell system for creating a moving projected visual wave pattern image, the system comprising:

a container having two parallel, planar, spaced apart, generally horizontally disposed, panels made of visually clear material, and movably mounting on an external support the panels being sealably joined by a plurality of side walls, and separated by a spacing held within and filling the container, at least two immissible transparent liquids of different specific gravities;

a motion generating means imparting motion to the container producing a distinct wave set within each of the liquids, the container motion being limited such that the wave sets are produced primarily by interaction between the separate liquids rather than between the liquids with the side walls, the wave sets producing a clearly delineated moving visual wave pattern in the container;

a light directing means directing a light beam normally toward one of the panels, the light beam being refracted by the moving wave pattern;

a surface, displaced from the container and positioned such that the refracted light beam passes through another of the panels and display the moving visual wave pattern as an image of the moving visual wave pattern having a constant and soothing wave pattern upon the displaced surface.

2. The liquid cell system of claim 1 wherein the difference in specific gravity of the liquids is a value between 0.01 and 0.1.

3. The liquid cell system of claim 1 wherein one of the liquids including a water-based liquid comprising a mixture of 10% to 25% ethanol and 75% to 90% distilled water.

4. The liquid cell system of claim 1 wherein one of the liquids including an oil-based liquid comprising a mixture of 25% to 35% 1,1,1-Trichloroethane and 65% to 75% Isoparaffinic Petroleum Solvent.

* * * * *